US009284707B2

(12) United States Patent
Barron et al.

(10) Patent No.: US 9,284,707 B2
(45) **Date of Patent: *Mar. 15, 2016**

(54) MEASURING UNDERGROUND PRESSURE

(71) Applicant: Uretek USA, Inc., Tomball, TX (US)

(72) Inventors: Brent Barron, Tomball, TX (US); Michael Bock, Tomball, TX (US)

(73) Assignee: URETEK USA, INC., Tomball, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/183,246

(22) Filed: Feb. 18, 2014

(65) Prior Publication Data

US 2014/0161540 A1 Jun. 12, 2014

Related U.S. Application Data

(63) Continuation of application No. 12/623,033, filed on Nov. 20, 2009, now Pat. No. 8,690,486.

(60) Provisional application No. 61/116,957, filed on Nov. 21, 2008.

(51) Int. Cl.
*E02D 3/12* (2006.01)

(52) U.S. Cl.
CPC ..... *E02D 3/12* (2013.01)

(58) Field of Classification Search
CPC ..... E02D 3/12; E02D 27/48
See application file for complete search history.

(56) References Cited

U.S. PATENT DOCUMENTS

| | | | | | |
|---|---|---|---|---|---|
| 3,690,106 | A * | 9/1972 | Tregembo et al. | 405/266 |
| 4,567,708 | A | 2/1986 | Haekkinen | |
| 5,542,786 | A * | 8/1996 | Blum | 405/240 |
| 5,595,245 | A * | 1/1997 | Scott, III | 166/250.1 |
| 5,888,022 | A * | 3/1999 | Green | 405/128.6 |
| 5,927,907 | A * | 7/1999 | Shiraishi | 405/258.1 |
| 6,634,831 | B2 | 10/2003 | Canteri | |
| 2003/0084716 | A1 * | 5/2003 | Patey et al. | 73/152.18 |
| 2004/0016295 | A1 * | 1/2004 | Skinner et al. | 73/152.52 |
| 2005/0158128 | A1 * | 7/2005 | Canteri | 405/266 |
| 2007/0251687 | A1 * | 11/2007 | Martinez et al. | 166/250.1 |

FOREIGN PATENT DOCUMENTS

| | | | |
|---|---|---|---|
| EP | 0851064 | A1 | 7/1998 |
| EP | 1536069 | A1 | 6/2005 |
| EP | 1914350 | A1 | 4/2008 |
| WO | 2004044335 | A1 | 5/2004 |
| WO | 2006050807 | A1 | 5/2006 |
| WO | WO 2006050807 | A1 * | 5/2006 |

* cited by examiner

*Primary Examiner* — Benjamin Fiorello
(74) *Attorney, Agent, or Firm* — Norton Rose Fulbright US LLP

(57) ABSTRACT

The present invention relates to in-place soil stabilization. Specifically, the present invention relates a method and device for measuring the increase in subsurface earth pressure during the injection of a stabilizing agent into the soil. The rise in sensor pressure indicates an increase in soil strength and bearing capacity. Therefore, real-time monitoring of these pressures may serve as a guide during the injection process.

20 Claims, 9 Drawing Sheets

MEASURING UNDERGROUND PRESSURE

CROSS-REFERENCE TO RELATED APPLICATIONS

This application is a continuation of U.S. patent application Ser. No. 12/623,033 to Brent Barron and Michael Bock, filed Nov. 20, 2009, and entitled "Method and Device for Measuring Underground Pressure," which claims priority to provisional application No. 61/116,957 filed Nov. 21, 2008, both of which are hereby incorporated by reference.

TECHNICAL FIELD

The present invention relates to in-place soil stabilization. Specifically, the present invention relates a method and device for measuring the increase in subsurface earth pressure during the injection of a stabilizing agent into the soil. The rise in sensor pressure indicates an increase in soil strength and bearing capacity.

BACKGROUND OF THE INVENTION

The present invention relates a method and system for measuring the increase in compressive strength/bearing capacity for the soil which serves as a foundation for earth-supported structures such as buildings, roadways, pavements, and airport facilities.

Such earth-supported structures require that the underlying soil have sufficient bearing capacity to support the weight of the structure as well as the additional weight exerted onto the structures during usage (live loads). In order to design a stable and durable structure, an accurate assessment of bearing capacity is required.

The bearing capacity of the underlying soil is not always sufficient for the intended structure's design and use. Therefore, remedial measures to increase the strength/bearing capacity of the soil system is required. The resulting increase in bearing capacity due to the remedial method of injecting a stabilizing agent into the underlying soil mass may be determined using this invention.

Existing structures may also experience differential deflection or settlement due to unconsolidated soil strata, water infiltration, decomposition of organic materials, void conditions, poorly executed site preparation during original construction, additional live loads, soils consolidation from on-site vibration caused by equipment or traffic operations, et cetera. Such problems can be corrected by increasing the compressive strength of compromised soils. Until the present invention, there was no way to efficiently and accurately monitor the increase in soil strength/bearing capacity during remediation by soil injection.

Various conventional systems for remedial stabilization and/or lifting to correct structural settlement (including driven piles, piers, segmented cylinder piles, micro-piles, and other systems) rely on transfer of structural weight to deeper, more solid soils or rely on the skin friction between soils and the exterior surface of the pile itself to increase load-bearing capability. Such construction systems are invasive, disruptive, time consuming, and often unsuitable for pavements, lightweight slab, and other applications.

Conventional stabilization and/or lifting systems also include the method originally described in U.S. Pat. No. 4,567,708, which entails the injection of a polymeric material beneath a built structure to fill voids and to create a expansive force from the increase in volume caused by the chemical reaction of the polymeric substance. This system did not address the need for soil remediation as indicated by measurement of increased confined soil strength at depth.

Conventional stabilization systems also include the method described in U.S. Pat. No. 6,634,831, which is incorporated by reference herein in its entirety, and which entails the injection of a material through holes or tubes into the soil to produce compaction of the contiguous soil. This method requires constant surface monitoring to detect the exact moment at which the soil or the structure begins to lift upward. This system does not address the need to continuously measure and monitor, at depth, the amount of improved compaction of the targeted soil. This system does not monitor unknown and unexpected migration of the injectable material away from the injection site creating unexpected surface lifting some distance away from the desired location.

The "Method for Reducing the Liquefaction Potential of Foundation Soils" (PCT Application TR2003/000083 dated Nov. 5, 2003) also teaches the strengthening of soils using expansive polymers as indicated only by surface testing of the project's structural slab, using "laser beams," which are presumed to be laser leveling systems. Such measurement fails to monitor and measure the precise confined soil strength at depth.

According to the Geotechnical Policy and Procedure manual produced by the Nebraska Department of Roads, a pressuremeter test may be used to determine the pressure at which the soil fails for a given depth. However, this test fails to be useful in determining the confined soil strength at a particular depth, and fails to provide a way to document evidence of confined soil pressures gained from the injection process.

The previously discussed patents teach only to monitor the surface for evidence of movement to indicate a sufficiency of injection material and soil strength. The previous systems fail to provide a system of monitoring and control in situ at depth and do not measure the differential, real-time increase in confined soil strength as the expanding polymer is introduced. The previous systems do not provide a means to document the strength gained from the injection process. Rather, the previous systems rely on monitoring for movement at the surface as a sort of proxy for what is occurring in the soil.

Previous methods have not met the need of providing in situ real-time soil strength data at various soil depths. Thus, previous methods also fail to indicate when geotechnical engineering specifications have been met or exceeded.

BRIEF SUMMARY OF THE INVENTION

The present invention solves the above problems by providing a method and device which permits real-time in situ measurement of soil strength at various depths. Consequently, the increase in soil strength can be monitored during the injection of the stabilizing agent into the soil.

In one embodiment, the present invention provides ongoing differential pressure change data taken from selected soil zone(s) both during the injection process and after completion of the process. Through the injection and monitoring of various substances, such as but not limited to expanding polymers, confined soil strength specifications can be achieved and assured. The invention can work with a variety of injectable substances, including but not limited to polymers, hydraulic systems, grout, cement, concrete, and chemicals.

While the present invention can work with a variety of systems, including hydraulic pressure systems, expanding polymer systems are preferred, in part because hydraulic pressure systems may sometimes cause the injected material to flow away from the targeted site.

The system disclosed herein provides engineers with a simple method to monitor and to document improvements in soil strength. This capability accommodates any desired safety margin for soil strength necessary to support present and future dead load and live load requirements.

The present invention uses small in situ pressure monitoring devices. Such devices can be hydraulic, pneumatic, or electric contact sensors. The pressure monitoring devices are placed in the soil near the injection site(s) to monitor the pressure at that location. One skilled in the art can select the location for strategic placement of such devices through tubes or drilled holes in the soil location chosen to monitor and achieve the desired soil strength improvement. The pressure monitoring device(s) may be placed above, below, or level with the injection site and may be laterally displaced from the injection site. Where more than one injection site is used, the device(s) may be placed between the sites, directly above or below each site, or any combination of the foregoing. The present invention is not limited to any particular location for the devices. However, such devices must be near enough to the injection site to measure pressure changes in the soil mass being stabilized.

Either before or after the pressure devices are in place, the stabilizing agent can be injected through small tubes or holes drilled from the surface and placed at desired depths and locations.

In some embodiments, the pressure sensor device is placed 20 feet, 10 feet, six feet, or three feet from the injection site. Other distances may be used, and the distances will depend on the particular job.

In weak soil, the injectable material (e.g., polymer) may move from the injection site and come into direct contact with the sensor. If this happens, the pressure sensor may give a false reading, thus preventing accurate measuring of the soil pressure. Therefore, in some embodiments, a thermocouple (temperature sensing probe) is provided at or near the pressure bulb to indicate if the injected substance has migrated onto the pressure sensor. In embodiments where the injected substance generates heat (e.g., expandable polymers), the thermocouple will quickly demonstrate through a temperature reading that the injected substance has contacted the thermocouple (and thus the device). Should this occur, injection of further material at that location is preferably stopped. The sensor is repositioned nearby (for example, approximately two feet away in any convenient direction), new injection tubes can be inserted, and injection of polymer is resumed.

As mentioned, it is within the scope of the present invention to monitor an increase in soil strength gain using any injectable substance known in the art. However, expandable polymers are preferred. Therefore, the remainder of this specification will generally refer to an embodiment with an expandable polymer, but the invention should not be limited to such.

Presently, the preferred reaction time for expansion of the polymer from liquid state to the expanded condition is less than one minute (30 to 45 seconds), though other reaction times may be used. In one embodiment, the short expansion time permits control of the injection process by allowing the injection technician periodically (typically every 5-20 seconds) to add more polymer into the soil strata to achieve greater expansive force and higher confined soil strength. When the desired confined soil strength is reached, as indicated by the pressure sensor, further injection is stopped and the material will cure and harden in place thus maintaining the new soil strength.

Where multiple injection sites are desired, an injection technician will then move to an adjacent site location and repeat the process of drilling holes, placing tubes, inserting a sensor, injecting polymer and monitoring the increased pressure results.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

The present invention can be used with one injection site or multiple injection sites. As an example of multiple injection sites, see U.S. Pat. No. 6,634,831, which has already been incorporated by reference in its entirety.

Figure 1:
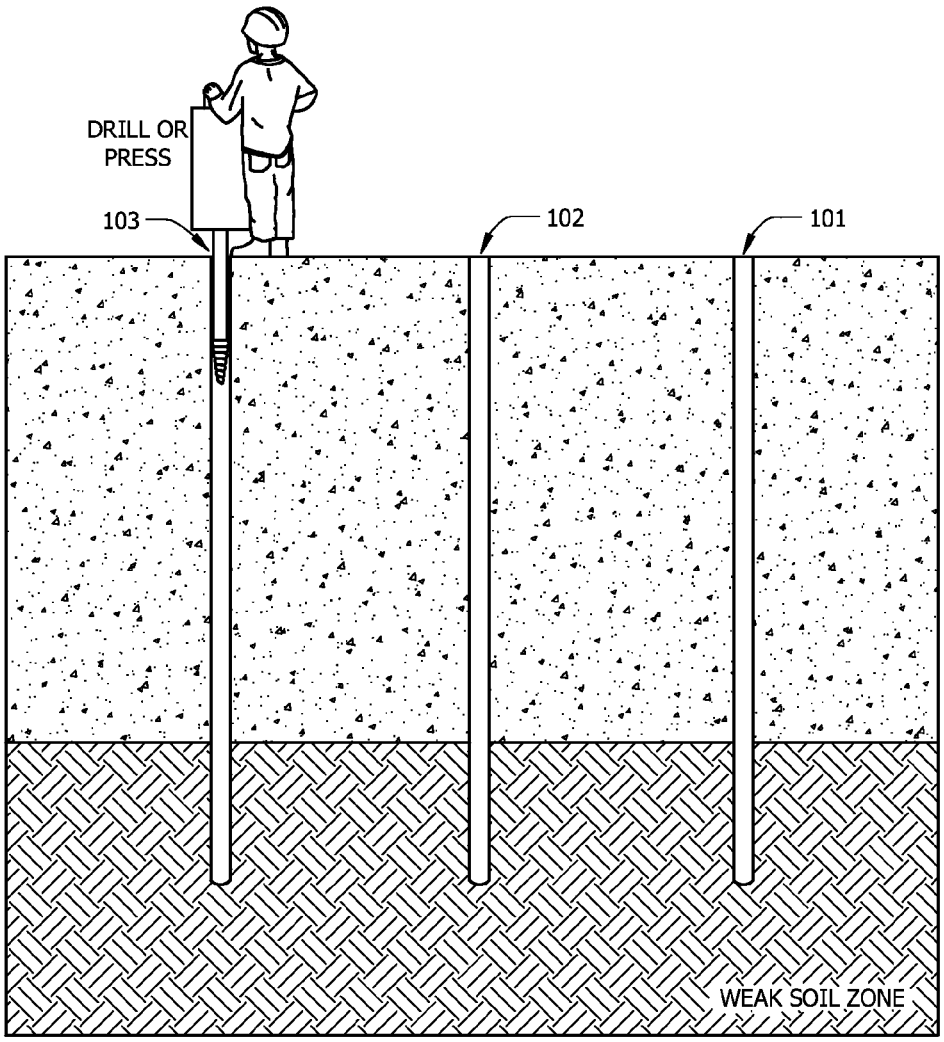
FIG. 1 is a profile view depicting holes drilled into soil according to one aspect of the present invention.

One or more holes are created by drilling, pressing, or vibration intrusion into compromised soil strata (less than desirable confined soil strength) subsurface locations. (See FIG. 1). As shown in FIG. 1, polymer injection holes, 101 and 103, and the sensor hole, 102, are drilled into the weak soil zone. In some embodiments, the holes are ⅝" in diameter. In other embodiments, the holes are spaced three to six feet apart.

Figure 2:
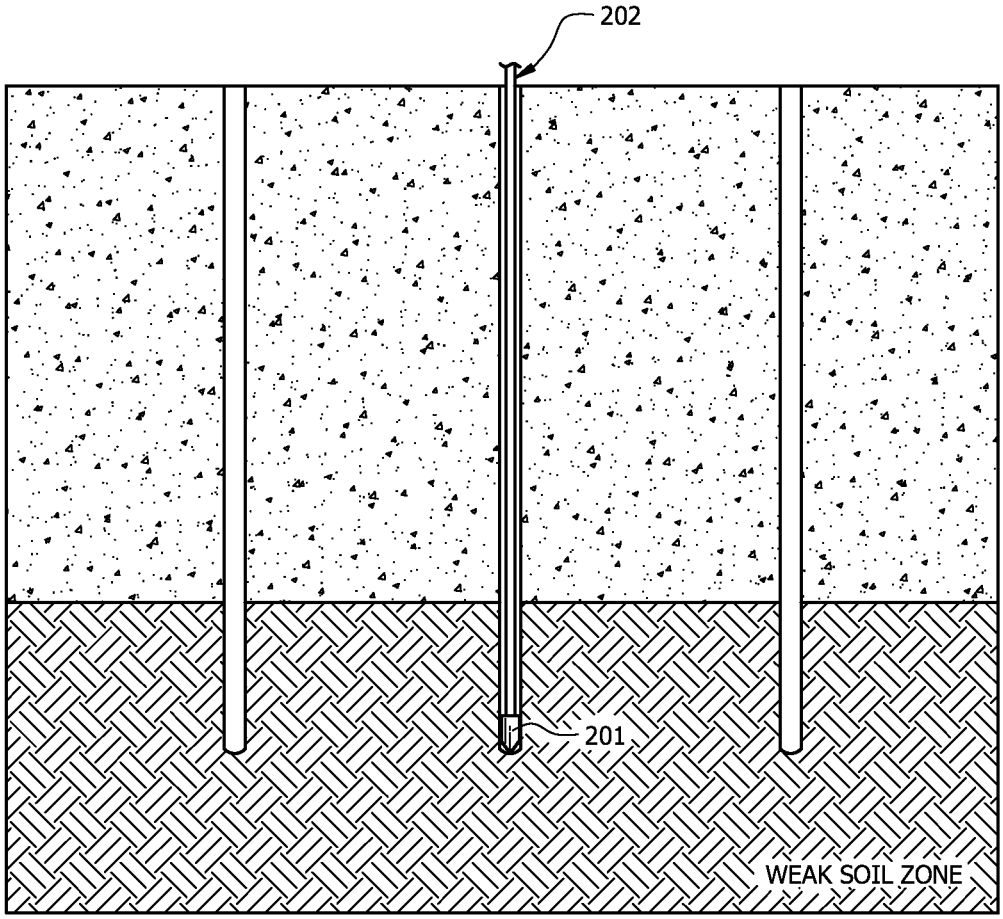
FIG. 2 is a is a profile view illustrating a pressure sensor tube and device lowered into a hole according to one aspect of the present invention.

Optionally, a tube may be placed in the one or more holes. Optionally, the lower tip of the tube is closed over with any device suitable for keeping soil from entering the tube. Non-limiting examples of such a device are tape or a small conical insert tip (i.e., made of metal or hard plastic). FIG. 2 shows a conical tip, 201, inserted into the sensor hole, 202. In some embodiments, the tube plus any optional tip is placed directly into the soil without a previous step of drilling a hole (i.e., the tube plus tip makes the hole).

Figure 3:
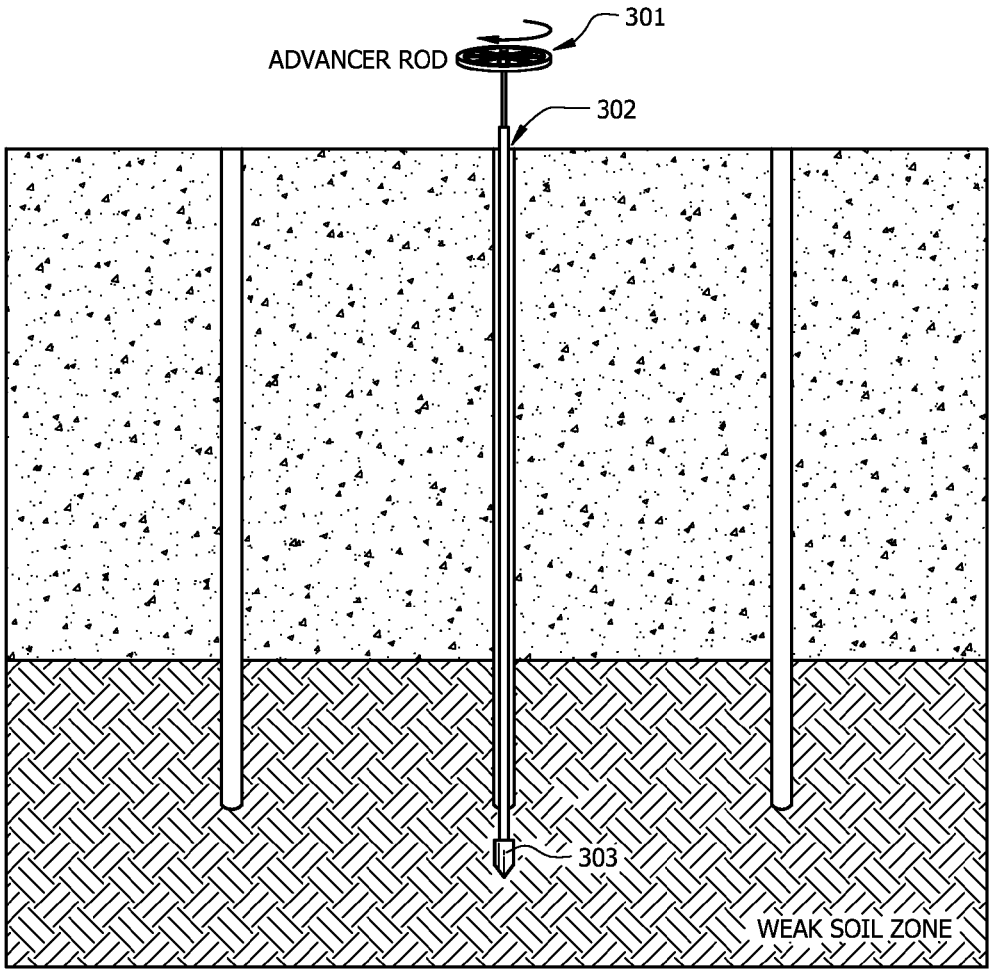
FIG. 3 is a profile view depicting an advancer rod being used to push the pressure sensor device into the soil according to one aspect of the present invention.

Optionally, an advancer rod, 301, (at least two inches longer than the tube, 302) is pushed into the tube to puncture or move the tape, 303, or other device at the lower tip of the tube and create additional space in the soil for the sensor (i.e., an additional two inches is cleared beneath the tube). See FIG. 3.

Figure 4:
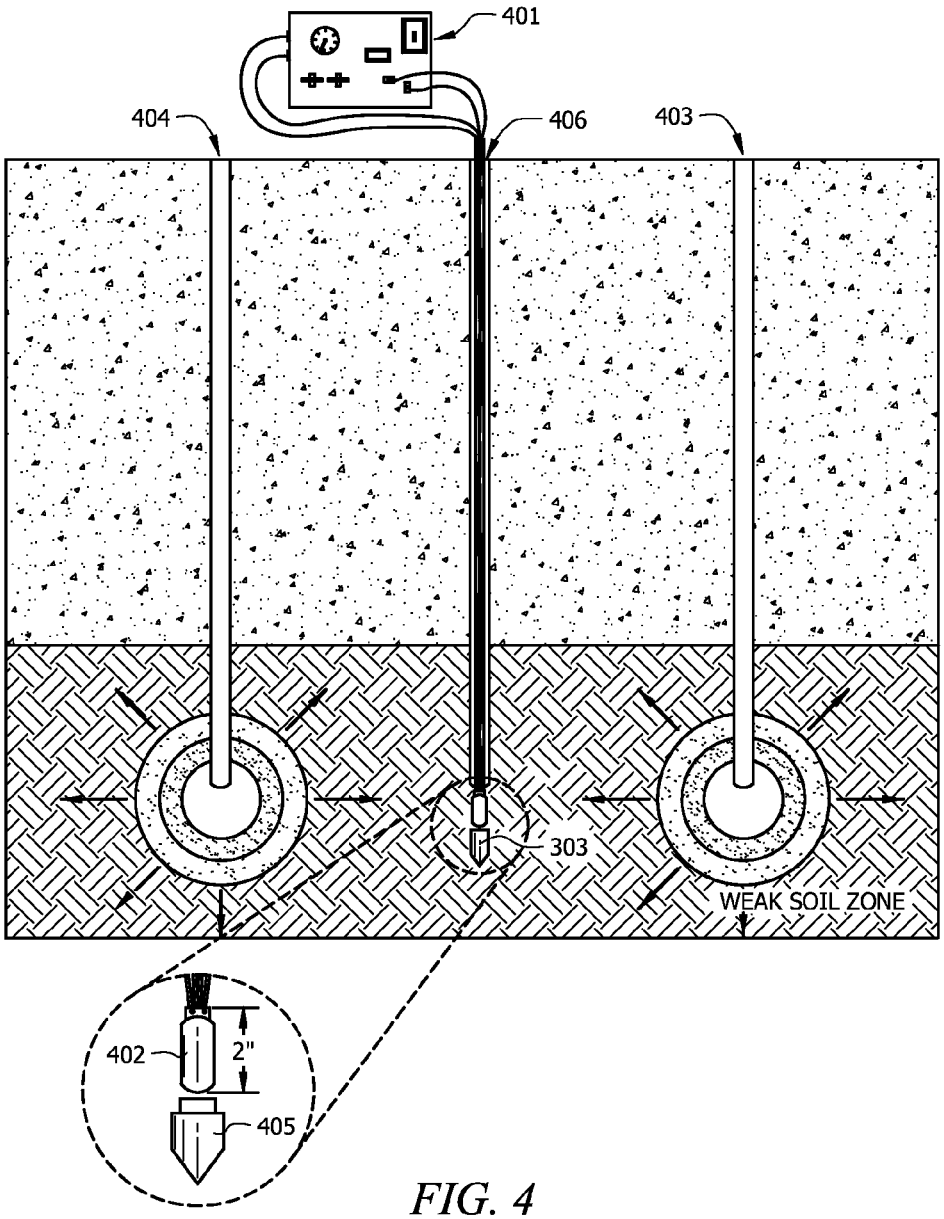
FIG. 4 is a profile view illustrating a pressure sensor device in the soil and expanding polymer injected nearby, and includes an enlarged view of the device, according to one aspect of the present invention.
Figure 6:
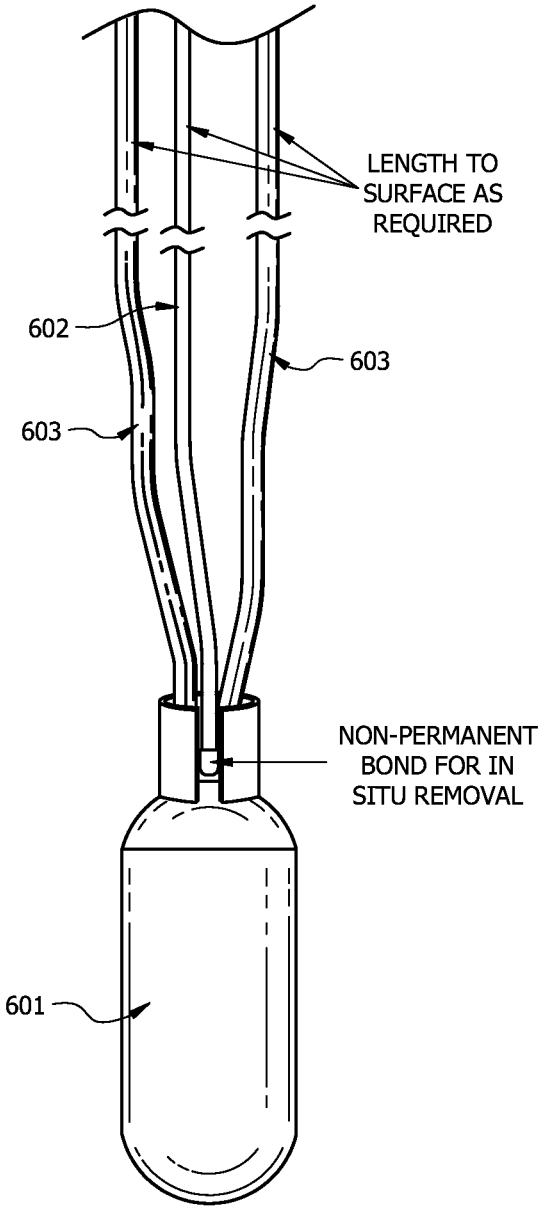
FIG. 6 is a schematic of a pressure sensor device according to one aspect of the present invention.

As shown in FIG. 6, the pressure sensor assembly includes a sensor bulb, 601, connected to a thermocouple wire, 602, and flexible tubing lines, 603. As shown in FIG. 4, the pressure assembly, 402, is inserted down the tube, 406, or hole to position the sensor bulb beneath the bottom of the tube. In other embodiments, the pressure sensor is lowered simultaneously with the tube and optional tip, 405. FIG. 4 also shows the control system, 401, that monitors the expansive force of the polymer being injected through holes 404 and 403. In other embodiments, the pressure sensor is lowered simultaneously with the advancer rod.

The upper ends of the thermocouple wire, 501, and both tubing lines, 502, are connected to the "Pump/Reservoir/Control Box" using "quick connect" insertion connections. The control box comprises a fill shut-off valve, 503, an overfill vent, 504, a vent shut-off valve, 505, a temperature gauge, 506, a pressure gauge, 507, an air pump, 508, and a liquid container, 509.

Figure 5:
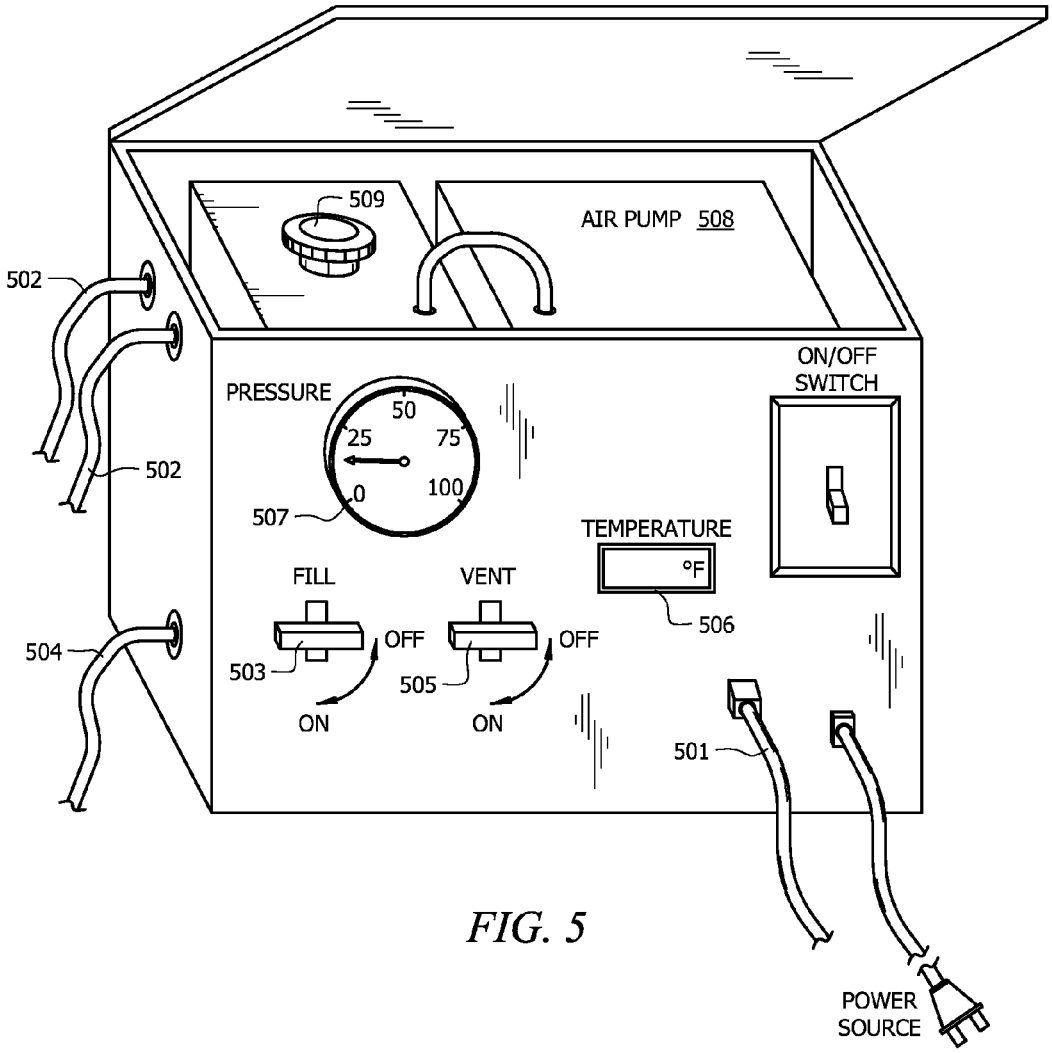
FIG. 5 is a schematic of a control box that can be used according to one aspect of the present invention.
Figure 7:
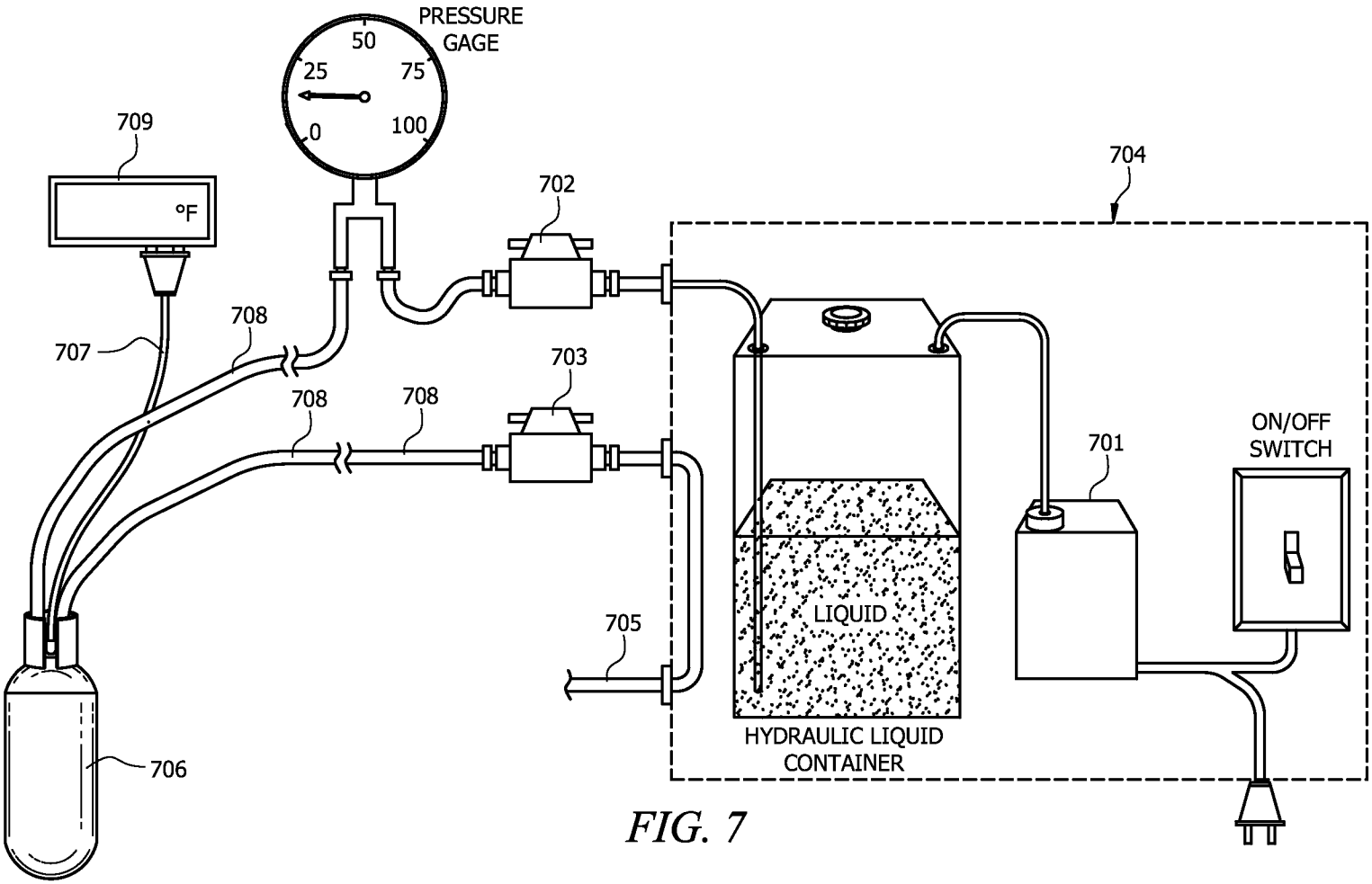
FIG. 7 is a schematic of a soil density improvement system according to one aspect of the present invention.

In one embodiment, both the fill valve, 702, and vent valve, 703, of the control box, 704, are opened and the air pump, 701, is activated until the overfill vent line, 705, flows with water (or any selected hydraulic fluid). Both the fill valve and vent valve are then closed. See FIG. 5 and FIG. 7. Thus, the pressure sensing bulb, 706, and flexible tubing, 708, are filled with liquid. The thermocouple wire, 707, is connected to the temperature gauge, 709.

Figure 8:
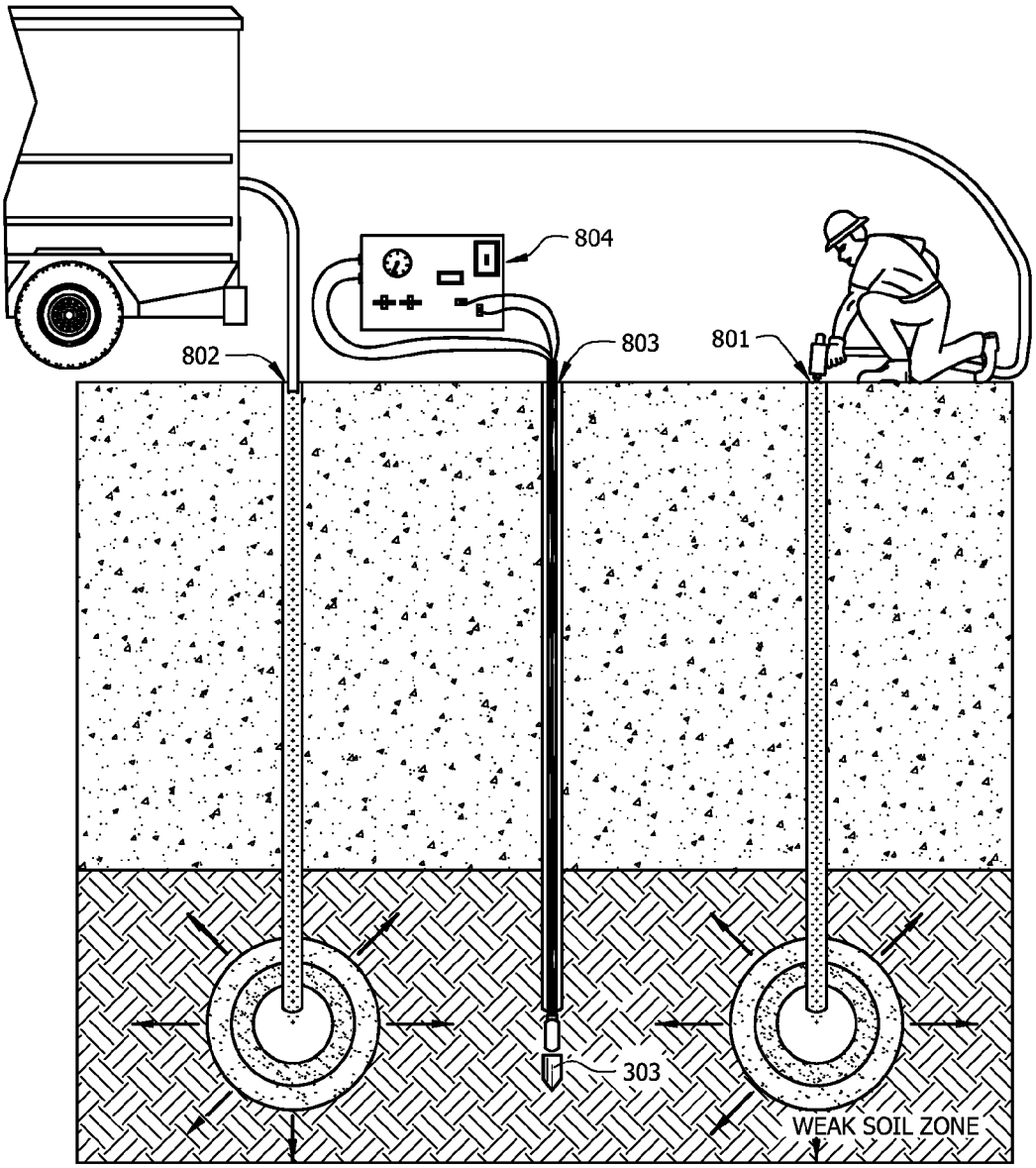
FIG. 8 is a profile view illustrating a soil density improvement system according to one aspect of the present invention.

Continuous or timed intermittent injection of expanding polymer is then started at one or more locations, 801 and 802, preferably adjacent tubes on opposite sides of the sensor tube location, 803. Injection of the material continues until the pressure gauge on the control system, 804, indicates the specified soil pressure has been achieved. See FIG. 8.

Figure 9:
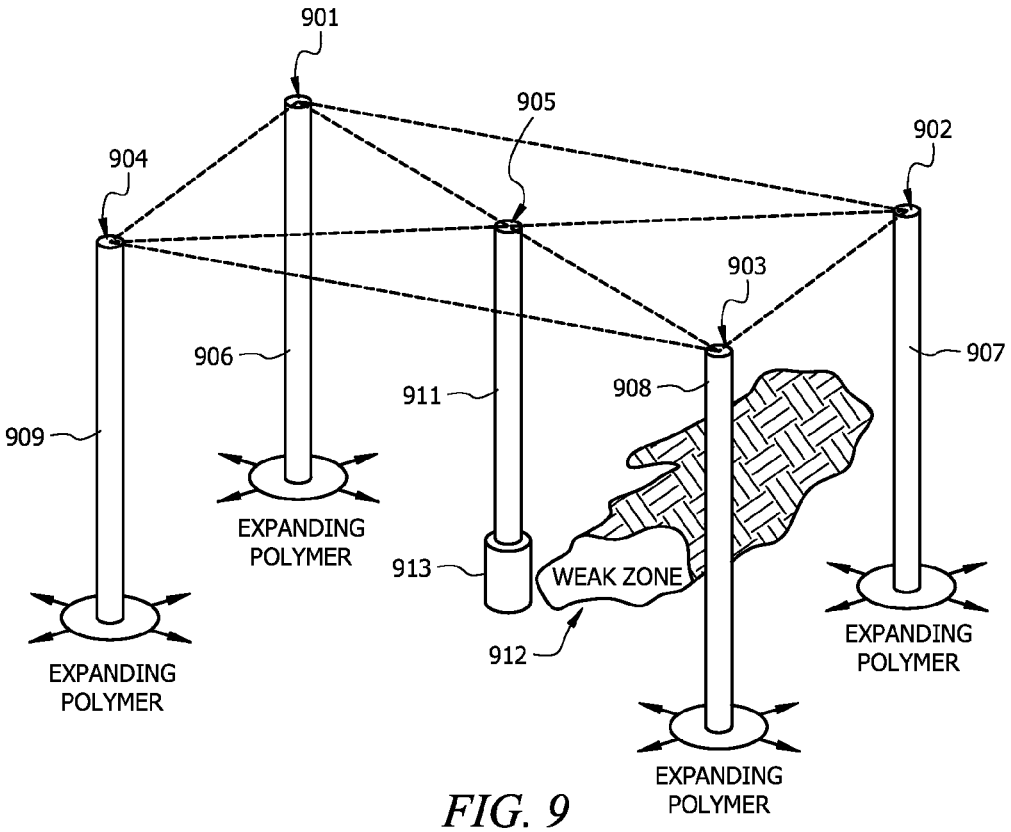
FIG. 9 shows the geometrical arrangement of the injection tubes with respect to the tube containing the pressure and temperature sensor.

In places having multiple injection sites, it may be desirous to arrange the tubes for injecting the expandable polymer in a geometrical configuration. For example, FIG. 9 shows injection tubes 906, 907, 908 and 909 arranged as a square. The injection holes will define the vertices or corners (901, 902, 903 and 904) of the geometrical shape. Tube 911 which contains a pressure sensor is located at the center (905) of the geometrical shape formed by the injection tubes. The geometrical shape may be any geometrical shape with an even number of vertices or any arrangement allowing the formation of one opposing pair. In this arrangement, each injection hole will have an opposing injection hole, forming opposing pairs of injection holes with a pressure hole in the middle. In FIG. 9, injection tubes 906 and 908 form opposing pairs, and injection tubes 907 and 909 form opposing pairs. In some situations, the injection tubes are arranged in a linear formation forming a set of one opposing pair. A square arrangement has two sets of opposing pairs, and a hexagon arrangement has three sets of opposing pairs.

By placing the pressure sensor at various depths and in the middle of the opposing pairs of injection holes, an injection technician can monitor and adjust the amount of polymer being added to each injection hole to ensure soil stabilization within the entire volume of the geometrical shape. It may not be necessary or desirable to add the same amount of expandable polymer to each injection tube. For example, in FIG. 9, it may be necessary to add more expandable polymer to injection tubes 903 and 902 than injection tubes 901 and 904. The placement of the pressure sensor allows the injection technician to easily monitor and adjust the amount of polymer being added to stabilize an asymmetrical weak zone in the soil. In general, this type of soil stabilization does not produce a visual effect at the surface that indicates complete stabilization of the asymmetric weak zone. Therefore, it is necessary to monitor the soil stabilization in situ.

Injection of the polymer is stopped and the process is continued at nearby locations following the same procedure outlined above until the targeted soil strata have been sufficiently strengthened.

In other embodiments, the pressure sensor is not filled with liquid, but instead is filled with gas. In other embodiments, the pressure sensor is an electric contact device with pressure sensitive outer edges. When pressure pushes the edges inward to a pre-determined setting, an electrical circuit is completed that activates a signal on the surface (i.e., a light, bell, etc.).

The examples disclosed herein are included to demonstrate preferred embodiments of the invention. It should be appreciated by those of skill in the art that the techniques disclosed herein represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

For example, a stabilization scenario where the present invention would be beneficial includes the stabilization of pavement on top of a base course made of uniformly-graded granular soil with poor compaction. In a specific embodiment, the pavement is Portland Cement Concrete (PCC) with a minimum slab thickness of six inches. The sub-grade underneath the base course is weak, fine-grained soil. The sub-grade is further divided into two distinct zones with the top zone being the soil that was compacted during construction and the bottom zone having weak, fine-grained soil with little to no compaction. The target zone for stabilization is the base course. Holes are drilled through the pavement and into the base course (the target stabilization zone). Injection tubes are placed in the injection holes with a tube comprising a pressure sensor located between the injection tubes. The stabilization agent is injected through the injection tubes into the base course thereby increasing the compaction of the uniformly-graded granular soil. In some embodiments, the stabilization agent is an injectable, two-component, expandable, high-density polyurethane foam (HDPF). In other embodiments, the HDPF is a free-rise material. In particular embodiments, the temperature of the HDPF coming out of the injection gun is between 100° F. and 130° F., 110° F. and 125° F., or 115° F. and 120° F. The density of the stabilization agent is between 1 and 5 pounds/cubic foot, 1 and 4 pounds/cubic foot, 1 and 3 pounds/cubic foot, 1 and 2 pounds/cubic foot, 2 and 5 pounds/cubic foot, 3 and 5 pounds/cubic foot, 4 and 5 pounds/cubic foot, 3 and 5 pounds/cubic foot, or 3 and 4 pounds/cubic foot.

In some examples, increasing the density of the soil causes movement in the upper strata of the soil and this motion may damage the structural component supported by the soil if this motion is excessive. However, the excessive motion is also used to indicate that the soil has been sufficiently solidified by monitoring movement at the surface. Since this excessive motion at the surface may cause damage to structural components supported by the soil, it is desirous to monitor the movement of the upper strata of the soil at depth before causing any motion at the surface.

In some alternate and additional examples, the densification of the soil may be monitored using means in addition to the in-situ pressure sensor. For example, the densification of the soil may also be monitored in the upper strata using a vertical scale with an soil spike attached to the bottom of the vertical scale that is capable of penetrating the structural component and entering the soil at a depth of six to twelve inches. As the soil is being solidified, the technician can monitor the movement of the vertical scale to determine when the sub-surface soil has been solidified without causing movement of the surface and/or without causing unnecessary damage to structural components. In some examples, the soil spike attached to the vertical scale is made of a rigid material. The rigid material may be ceramic or metal. In specific examples, the object attached to the vertical scale is a nail. In particular examples, the nail is between six inches and three feet long or of a sufficient length to penetrate into the soil via a drilled hole through the built structure. If no structure is present on a soil site, the soil spike or nail attached to the bottom of the vertical scale can simply be inserted into the soil for monitoring at depth.

Thus, the invention can relate to any of the following:

- A method of monitoring the remediation of weak soils from injection of expansive polymer by using a pressure sensitive bulb device placed at targeted subsurface soil strata to monitor the increase in confined soil strength at the selected location.
- A hydraulic pressure sensing device capable of being placed through drilled holes to any selected soil strata and depth, typically 50 feet or less.
- A miniature hydraulic pressure sensing device may be used at depths of 100 feet or more, depending on hole drilling and polymer injection systems. In this case, the length of the bulb itself would be increased to accommodate more hydraulic liquid and the flexible tube size would be increased to lower the inherent friction losses within the tubing which increases the accuracy of the pressure gauge to reflect the confined soil pressure at depth.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for stabilizing soil comprising:

drilling at least one injection hole to at least one injection site located in in situ soil to be stabilized;

drilling at least one monitoring hole in the in situ soil to be stabilized;

placing, through the at least one monitoring hole, a pressure monitoring device in the in situ soil to be stabilized;

injecting into the at least one injection site a soil stabilization agent;

receiving, through the soil located between the pressure monitoring device and the at least one injection site, a measurement of the pressure of the soil as the soil stabilization agent is being injected; and terminating injection of the soil stabilization agent when the pressure monitoring device indicates the soil has exceeded a predetermined pressure.

2. The method of claim 1, wherein the injecting step is repeated at different depth levels for stabilizing layers of soil.

3. The method of claim 2, wherein the depth levels are spaced approximately 1 meter from each other.

4. The method of claim 1, wherein the soil stabilization agent is a polymer.

5. The method of claim 4, wherein the polymer is an expandable polymer that produces heat upon expanding.

6. The method of claim 1, wherein the step of injecting the soil stabilization agent is performed in time intervals ranging from 5 to 20 seconds.

7. A method for stabilizing soil comprising:

drilling at least one injection hole to at least one injection site located in in situ soil to be stabilized;

drilling at least one monitoring hole in the in situ soil to be stabilized;

placing, through the at least one monitoring hole, a temperature sensor in the in situ soil to be stabilized;

injecting into the at least one injection hole a soil stabilization agent;

receiving, through the soil located between the temperature sensor and the at least one injection site, a temperature measurement as the soil stabilization agent is being injected; and terminating injection of the soil stabilization agent when the temperature sensor registers a predetermined temperature increase.

8. The method of claim 7, wherein the injecting step is repeated at different depth levels for stabilizing layers of soil.

9. The method of claim 8, wherein the depth levels are spaced approximately 1 meter from each other.

10. The method of claim 7, wherein the soil stabilization agent is a polymer.

11. The method of claim 10, wherein the polymer is an expandable polymer that produces heat upon expanding.

12. The method of claim 7, wherein the step of injecting the soil stabilization agent is performed in time intervals ranging from 5 to 20 seconds.

13. The method of claim 7, wherein the temperature sensor is a thermocouple.

14. A system for stabilizing soil comprising:

at least one first tube inserted to an injection site in in situ soil to be stabilized;

at least one second tube inserted into the in situ soil to be stabilized;

an in situ pressure monitoring device, wherein the in situ pressure monitoring device is configured to measure the pressure of the soil located between the pressure monitoring device and the at least one injection site;

a soil stabilization agent, wherein the soil stabilization agent is injected through the at least one first tube;

a pressure gauge located at the surface connected to the pressure monitoring device; and a device for terminating the injection of the soil stabilization agent.

15. The system of claim 14, wherein the device for terminating the injection of the soil stabilization agent is selected from the group consisting of a valve and a pump switch.

16. The system of claim 14, wherein the soil stabilization agent is a polymer.

17. A system for stabilizing soil comprising:

at least one first tube inserted to an injection site in in situ soil to be stabilized;

at least one second tube inserted into the in situ soil to be stabilized;

a temperature sensor located within the in situ soil to be stabilized, wherein the temperature sensor is configured to be placed into the soil by way of the at least one second tube;

a soil stabilization agent, wherein the soil stabilization agent is injected through the at least one first tube;

a temperature gauge located at the surface connected to the temperature sensor; and a device for terminating the injection of soil stabilization agent.

18. The system of claim 17, wherein the device for terminating the injection of the soil stabilization agent is selected from the group consisting of a valve and a pump switch.

19. The system of claim 17, wherein the soil stabilization agent is an expandable polymer that produces heat upon expanding.

20. The system of claim 17, wherein the temperature sensor is a thermocouple.

* * * * *